US005356222A

United States Patent [19]

Kettner et al.

[11] Patent Number: 5,356,222

[45] Date of Patent: Oct. 18, 1994

[54] INTERLOCKING CLOSURE FOR PLASTIC STORAGE BAGS WITH CONFIRMING COLOR STRIPES

[75] Inventors: Catherine E. Kettner, Appleton, Wis.; Jack R. McLean, Richmond, Va.; Mladomir Tomic; Wayne M. Wegner, both of Appleton, Wis.

[73] Assignee: Reynolds Consumer Products Inc., Appleton, Wis.

[21] Appl. No.: 59,607

[22] Filed: May 12, 1993

Related U.S. Application Data

[63] Continuation-in-part of Ser. No. 840,250, Feb. 24, 1992, Pat. No. 5,248,201.

[51] Int. Cl.[5] ..... B65D 33/24

[52] U.S. Cl. ..... 383/63; 24/587

[58] Field of Search ..... 383/63, 64, 65; 24/587

[56] References Cited

U.S. PATENT DOCUMENTS

| | | | |
|---|---|---|---|
| 3,054,434 | 9/1962 | Ausnit et al. . | |
| 3,198,228 | 8/1965 | Naito . | |
| 3,226,787 | 1/1966 | Ausnit . | |
| 3,338,285 | 8/1967 | Jaster . | |
| 3,389,733 | 6/1968 | Siegel . | |
| 3,533,548 | 10/1970 | Taterka . | |
| 3,765,597 | 10/1973 | Brieske . | |
| 4,186,786 | 2/1980 | Kirkpatrick | 383/63 |
| 4,285,105 | 8/1981 | Kirkpatrick | 383/63 |
| 4,363,345 | 12/1982 | Scheibner | 24/587 |
| 4,372,014 | 2/1983 | Simpson | 24/587 |
| 4,428,788 | 1/1984 | Kamp | 383/63 |
| 4,578,813 | 3/1986 | Ausnit . | |
| 4,787,880 | 11/1988 | Ausnit | 383/63 |
| 4,829,641 | 5/1989 | Williams . | |
| 4,964,739 | 10/1990 | Branson et al. . | |
| 5,012,561 | 5/1991 | Porchia et al. | 24/587 |
| 5,248,201 | 9/1993 | Kettner et al. | 383/63 |

*Primary Examiner*—Stephen P. Garbe
*Attorney, Agent, or Firm*—Alan T. McDonald

[57] ABSTRACT

An interlocking closure device for a plastic bag includes two closure elements which interlock over a predetermined length to selectively open and close the opened end. The first closure member projects from an opaque web and is formed with brightly colored tips co-extruded with the contrasting opaque web and connecting portions. The second closure element has a translucent web co-extruded of clear resin with opaque tips connected to that web with clear connecting portions formed of clear resin. When the tips of the first and second closure elements properly mate together, the bright color is highly contrasted against the opaque color and appears as a pair of parallel bands through the transparent or translucent web.

7 Claims, 3 Drawing Sheets

INTERLOCKING CLOSURE FOR PLASTIC STORAGE BAGS WITH CONFIRMING COLOR STRIPES

RELATED APPLICATIONS

The present application is a continuation-in-part of Application Ser. No. 07/840,250, filed Feb. 24, 1992, now U.S. Pat. No. 5,248,201 for "INTERLOCKING CLOSURE FOR PLASTIC STORAGE BAGS WITH CONFIRMING COLOR STRIPS", assigned to the same assignee, Reynolds Consumer Products, Inc.

TECHNICAL FIELD

The present invention relates generally to storage containers having interlocking closure strips and, more particularly, to colored interlocking closure strips wherein the colors are used to confirm whether the two strips are fully interlocked together.

BACKGROUND ART

Various types of plastic bag containers utilize a pair of closure strips respectively having male and female members which interlock together to close the open end of the container and seal the interior from the external environment. The strips and associated container are typically formed from thermoplastic material. The strips are usually formed by extrusion and then connected to the side walls of the container circumscribing the open end by heat sealing or other suitable fastening means. The closure strips and container body may also possibly be formed as a single piece by extrusion.

The interlocking closure strips on the bag bodies are particularly useful for improving the longevity of contents in the container when the closure is fully closed by sealing such contents from the external ambient environment. The closure fastening strips and the bag bodies themselves are generally transparent and the strips therefor have the same general appearance as the bag body. In other words, it is often difficult to actually determine whether the male and female closure strips are fully mated together, so as to completely seal the bag interior.

The above misalignment problem occurs from the user's inability to visually identify when the interlocking closure strips are fully mated to form a seal. As a means for enabling such visual verification, it is known to use a color change means wherein male and female interlocking members having different colors are employed and, upon successful interlocking, blend to provide yet a different color. For example, in U.S. Pat. No. 4,829,641 to Williams, assigned to First Brands Corporation, Danbury, Conn., there is disclosed an interlocking closure device wherein two closure elements are oriented to be interlocked over a predetermined length to seal a bag. Each of the closure elements has different colors for establishing visually the completeness of the mating of the closure elements by providing a color different from the closure elements when the closure elements are successfully and fully fastened. Therein, a color change enhancement member is introduced in an internal channel of a translucent closure element so that the closing and opening of the closure device is more easily detected by visual inspection.

Numerous problems exist in the aforementioned patent and other prior art devices wherein different colors are employed and upon successful interlocking provide yet a different color. For example, in the aforementioned patented prior art, the male and female interlocking members are completely colored instead of being formed from transparent material such as clear resin. The requirement that a colored resin be employed for the entirety of these male and female closure members instead of a clear resin unnecessarily increases costs, i.e., clear resin is less expensive than colored resin.

Another problem associated with the aforementioned prior art is that care must be exercised to insure that two different colors are being used which can be successfully blended together while providing the ability to visually confirm full closure. For example, separate colors to be blended into a third color must be selected so that sufficient contrast is provided between the blended color and the separate colors.

It is accordingly one object of the present invention to enable a user to easily verify whether two closure elements are completely interlocked together.

Another object is to facilitate visual inspection and confirmation of complete interlocking without utilizing additional ribs or guide members on colored interlocking closure devices or by utilizing color change members.

Still another object is to enable visual inspection of a completely interlocked closure device to occur by utilizing the presence of colors but without requiring color change by color blending.

Another object is to utilize color to visually confirm complete interlocking with a minimum of or without color resin to thereby reduce manufacturing costs.

SUMMARY OF THE INVENTION

A container comprises a pair of side walls defining a container interior and at least one open end. A closure device including a first closure element and a second closure element, at least one of which is formed with a web through which color is observable, extend along the open end and are mateable with each other in interlocking engagement so that, upon successful engagement of the elements along substantially their entire respective lengths, the open end is closed. The first and second elements or members disposed between the webs, are visually observable through the color observable web. In accordance with the invention, at least one of the first and second elements is colored a certain color so that upon substantially entirely complete mating of the closure elements, the certain color is visually observable through the color observable web as a continuous band of said certain color without any color change.

In accordance with a preferred embodiment of the invention, a container comprises a pair of side walls for defining a container interior and at least one open end. A closure device includes a first closure element and a second closure element each formed with a web respectively extending along the side walls adjacent the open end. The first and second elements are mateable so that, upon mating engagement along their substantially entire respective lengths, said open end is substantially entirely closed. At least one of the first and second closure elements is colored a certain color so that upon substantially entirely complete mating of the first and second elements, the certain color is visually observable through an opposing one of the webs as a continuous band of the certain color. The web carrying the first or second closure element of said certain color is opaque to provide contrast with said certain color when the first and second closure elements are viewed through the said opposing web.

Preferably, only the tip portions of said one of the first and second closure elements is colored said certain color and the remaining portions of said one of the first or second closure elements connecting the tip portion to the associated web is also opaque. Furthermore, the tip portions of the other of said first and second closure elements may also be opaque to provide further contrast with the tip portions of said certain color.

Preferably, the portions of said other of the first or second closure elements connecting the tips to the said opposing web are made of a transparent or clear resin co-extruded with the said tip portion.

In accordance with another embodiment of the invention, a portion of the first closure element, adapted to directly face and visually observable through the color observable web carrying the second element, is colored the certain color and a portion of the second element adapted to directly face and visually observable through a color observable web carrying the first element is colored a second color different from the certain color so that, upon complete mating, the said certain color and said second color are observable through the respective opposing webs as continuous bands of their respective colors and, upon incomplete mating, both said certain color and said second color are visually observable through the opposing web as adjacent bands of said colors along the region of incomplete mating and as an indication thereof.

In accordance with a different embodiment of the invention, the first and second elements are each said certain color.

In one aspect of the invention, at least one of the first and second elements includes a stem or rib projecting upward from the web. This rib extends the full length of the closure element and supports a distal end or tip. The portion which is the certain color may be the tip and rib.

An upward facing surface of the tip which is the surface facing away from its associated web may be said certain color and an opposing surface of said tip which is the surface facing toward the associated web may be the second color. The opposing surface and thereby the second color are visually observable through its associated web when the first and second elements have incompletely mated and the second color is hidden from view through the associated web when the first and second elements have completely mated.

The colors formed on the upward facing surface and opposing surface of the tip may be co-extruded with the remainder of the member being a substantially transparent or clear resin co-extruded with the colors. The colors may also be printed on clear resin.

In accordance with a further aspect of the invention, a pair of second elements are spaced from each other along one web and a pair of first elements of like construction as the second elements are spaced from each other on the opposite web a distance slightly greater than the spacing between the second elements. A wall projecting upwardly from the associated web extends between the first elements to define locking cavities or channels therewith adapted to respectively receive the second elements therein whose tips interlock by interfitting with and beneath the corresponding tips of the first elements. In one embodiment of this construction, the tips of the first and second elements are each said certain color. In a further aspect of this construction, the tips of at least one of the first or second elements are each said certain color and the tips of the others of the first and second elements are the second color. In accordance with yet an alternative aspect of this construction, the upward facing surfaces of the tips and an opposing surface of the tips are respectively said certain and second colors so that, in the event of incomplete mating, the first and second colors are visually observable through one of the color observable webs.

A method of determining whether a flexible bag container is closed is also disclosed. The container has at least one open end carrying a closure device which includes a first closure element and a second closure element which are mateable with other so that upon mating engagement along their substantially entire lengths, the open end is substantially entirely closed. The method comprises the steps of inserting the first closure element into the second closure element and then visually observing the mated elements through a color observable web supporting an associated one of the first or second elements to determine whether the certain color appears through the web as a continuous band of said certain color, signifying that full mating has occurred. The said certain color is formed in at least one of the first or second closure elements.

In a further aspect of this invention, the first elements are said certain color and the second elements are a second color. Thereby, each color is separately visually observable through an opposing web as a continuous band of said certain or second color to signify full mating. In the event of incomplete mating, both the certain color and the second color are visually observable through one of the webs.

Still other objects and advantages of the present invention will become readily apparent to those skilled in this art from the following detailed description, .wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
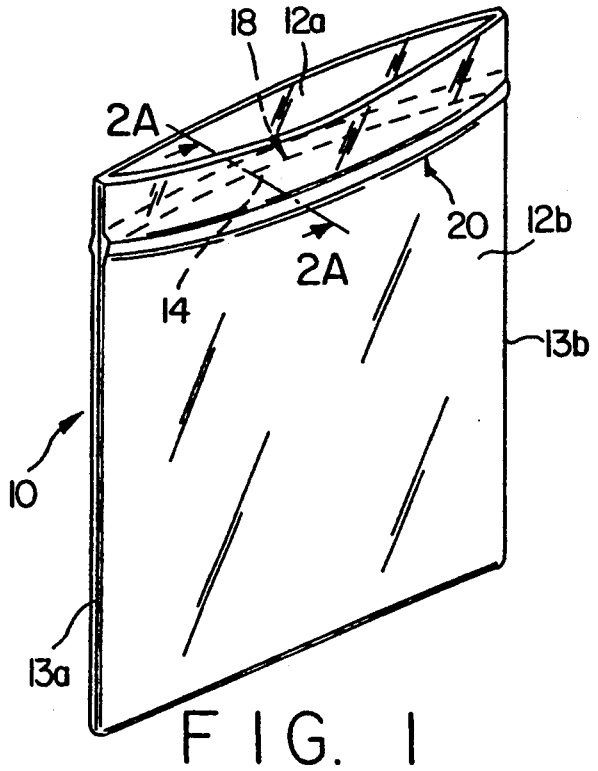
FIG. 1 is an illustration of a transparent flexible bag formed with a pair of interlockable first and second closure elements to which the present invention is applied.

FIG. 1 is an illustration of a container such as a clear flexible bag 10 formed with a pair of plastic side walls 12*a* and 12*b* which may be heat sealed together along their edges 13*a*,13*b* to define a container interior 14 having an open end 16. The open end 16 is defined by upper edge portions 17 of the side walls 12*a*,12*b* extending between the heat sealed edges 13*a*,13*b*. An interlocking closure device in accordance with the present invention includes first and second closure elements 18 and 20 respectively extending along the upper portion 17 of each side wall 12*a*,12*b* in inwardly spaced relation to the open end 16. One of the closure elements 20 is formed with a pair of second members 24 and the other of the closure elements 18 is formed with a pair of first members 26 as described hereinafter. In a preferred embodiment (depicted in FIGS. 2A and 2B only), portions 27 of the second members 24 are colored a first or certain color and portions 29 of the first members 26 are colored a second color. When the two closure elements 18,20 properly mate together (FIG. 2A), the first colors 27 only are visually observable through the color observable (e.g., translucent) webs 28,30 carrying the second and first members 24,26. When improperly mated (FIG. 3B), both the first and second colors 27,29 are visually observable through each translucent web 28,30 as adjacent bands of colors along the length of improper mating.

Figure 2A:
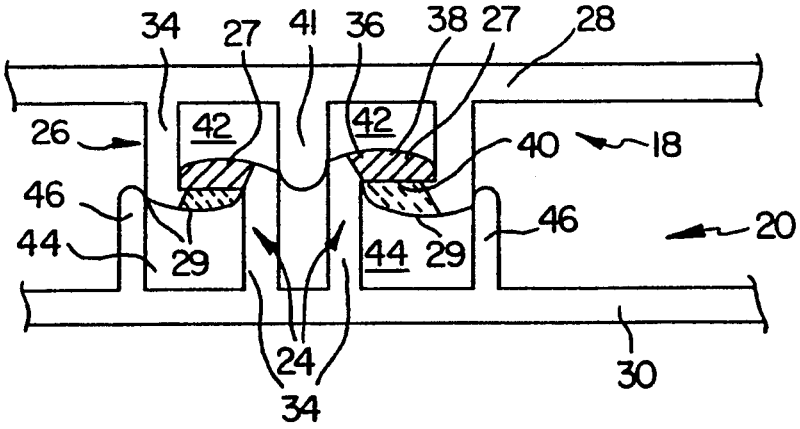
FIG. 2A is a sectional view taken along the line 2A—2A of FIG. 1 depicting structural specifics of a first embodiment of this invention.
Figure 2B:
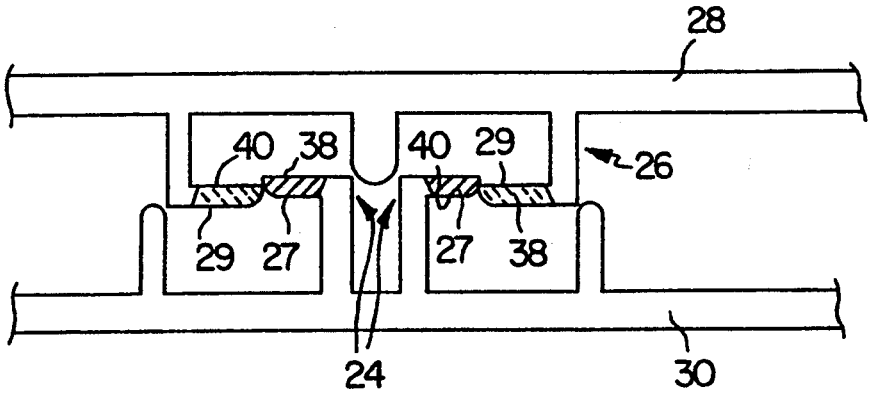
FIG. 2B depicts the first embodiment of FIG. 2A wherein the first and second closure elements are not successfully interlocked to form a seal.

FIG. 2A is an illustration of a first embodiment of the invention wherein the second closure element 20 includes a pair of hook-like projections 24 projecting from a translucent continuous web 30 in spaced parallel relationship to each other. Each hook-like projection 24 is formed with a stem or stalk 34 extending generally perpendicular to the web 30 and having a hook-like distal end 36 or tip extending approximately perpendicular to its stem 34. The outermost surface 38 of the tip 36 which faces away from the associated web 30 is generally defined by a convex curve and an inner surface 40 of the tip which faces the web 30 is either straight or slightly concave.

The first closure element 18 is also formed with a pair of hook-like projections 26 extending from its associated continuous web 28. These hook-like projections 26 are also formed with a stem 34 and a hooked tip 36 that may be identical in construction to the second members 24 except that the stems 34 of the first hooked projections 26 are spaced further apart from each other than the stems on the second closure elements 24 to define, in cooperation with a wall 41 extending parallel to and between the first members 26, a pair of locking cavities 42. The second hook projections 24 are adapted to enter into the locking cavities 42 by virtue of resiliently yielding bias of the tips 36 of the first and second hook-like projections 24,26 as the continuous webs 28,30 are brought together under manual finger pressure during closure of the bag 10. As depicted in FIG. 2A, full mating engagement of the second and first closure elements 24,26 results in sealing contact between portions of the outermost surface 38 of the tips of the second members 24 with wall 41 of the locking cavity 42 and corresponding sealing contact between the outermost surfaces of the tips of the second members 26 with the corresponding locking cavity 44 formed between the hook-like projections 24 and associated walls 46 formed outwardly and parallel to the hook-like projections.

As mentioned above, the interlocking extremities or tips 36 of the second and first elements 24,26 are guided into interlocking engagement within the respective locking cavities 42,44 in response to compressive force placed on the elements 18,20 as in the clamping together of the continuous webs 28,30 under manual finger pressure. In the fully mated position of FIG. 2A, the outermost or upward facing surfaces 38 of the tips 36 on the second elements 24 directly face the translucent web 28 carrying the first elements 26 and are visually observable through the web 28. Likewise, the outermost surfaces 38 on the tips 36 of the first elements 26 are visually observable through the web 30 carrying the second elements 24. Therefore, in accordance with a preferred embodiment of this invention, the tips 36 or extremities of the second elements 24 and thereby the outer surfaces 38 thereof are colored a certain color 27 and the tips 36 or extremities of the first elements 26 and their outer surfaces 38 thereof are colored a second color 29 different from the first color. Thereby, when the second and first elements 24,26 are fully mated together, the first or certain color 27 on the second element tips are visually observable as continuous bands of that color through the translucent web 28 of the first elements 26. Likewise, the second color 29 formed on the first element 26 are visually observable as continuous parallel bands through the continuous web 30 of the second elements 24.

In the preferred embodiment, the second element tips 36 are coextruded as the first color 27 with the transparent stems 34 which are formed from a clear resin. The first element tips 36 are coextruded as the second color 29 with transparent stem 34. Optionally, the second and first element tips 36,36 may also be formed of clear resin, instead of colored resin, with the color 27 or 29 being respectively printed on the associated first or second element tip. In either case, the respective color 27 or 29 is visible on both the outer and inner surfaces 38,40 of the associated tip. Thereby, when the closure elements 18,20 have not fully mated together, the inner surfaces 40 of the first and second element tips 36 opposing their associated webs 30,28 are not fully juxtaposed together (and therefore hidden from view through the webs) since the first and second element tips are not interlocked but are instead somewhat wedged together, side by side, in the manner depicted in FIG. 2B. In accordance with a unique feature of the present invention, this incomplete mated condition is visually observable through one or the other of the continuous webs 28,30 since, for example, the outermost surfaces 38 of the first element tips of said certain color 29 will be disposed side by side or adjacent the innermost surface 40 of the second element tips of the color 27 and, therefore, both the first and second colors 27,29 will be visible as adjacent bands of colors through the continuous web 30. Likewise, the outermost surface 38 of the second element tips 24 will be visually observable as bands of the first color 27 through the web 28 carrying the first element tips 26 and the innermost surfaces 40 of the first element tips will also be observable as bands of the second color 29 through their associated web 28.

The feature of utilizing first and second colors 27,29 in the unique manner set forth above enables easy verification of complete mating by allowing the user to simply search for the presence of only one of two colors 27,29 through only one of the translucent webs 28,30 without searching for color blending as in the prior art.

Further, since there is no requirement in the present invention that the colors blend together to form a third color, the first and second colors 27,29 may be chosen without concern as to whether the colors are blendable to form a third color.

Unlike the known prior art wherein the entirety of each first and second closure element is formed of a colored resin, the unique manner in which the present invention functions enables minimal use of a colored resin which is more expensive than a clear resin since, in the preferred embodiment, typically only the interlocking tip extremities 36 of the second and first elements 24,26 are either the first or second color 27,29 with the remainder of the elements (e.g., the stems 34) being co-extruded of a clear and less expensive resin. Of course, if desired, the stems 34 may be colored resin. In addition, as mentioned above, the color 27 or 29 may be printed on the tips 36 instead of being coextruded as a colored resin.

Figure 3:
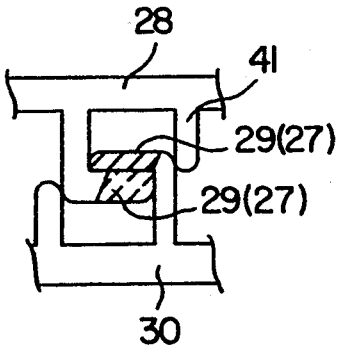
FIG. 3 depicts a second embodiment of the invention.

It is within the scope of this invention to form the tip extremities 36 of both the first and second closure elements of a single color (e.g., 27 or 29) as depicted in FIG. 3. In this embodiment, complete mating of the elements 18,20 is visually ascertainable by the presence of a continuous band of color 27,29 of substantially uniform width observable through one or the other of continuous webs 28,30. In the event of incomplete mating, this condition would be visually observable by a band of color of varying width. In other words, the portions of the first and second elements which have not successfully interlocked would appear as a band portion of color of twice (e.g., FIG. 2B) the thickness relative to portions (e.g., FIG. 2A or 3) of the elements which have successfully interlocked in mating engagement.

Figure 4:
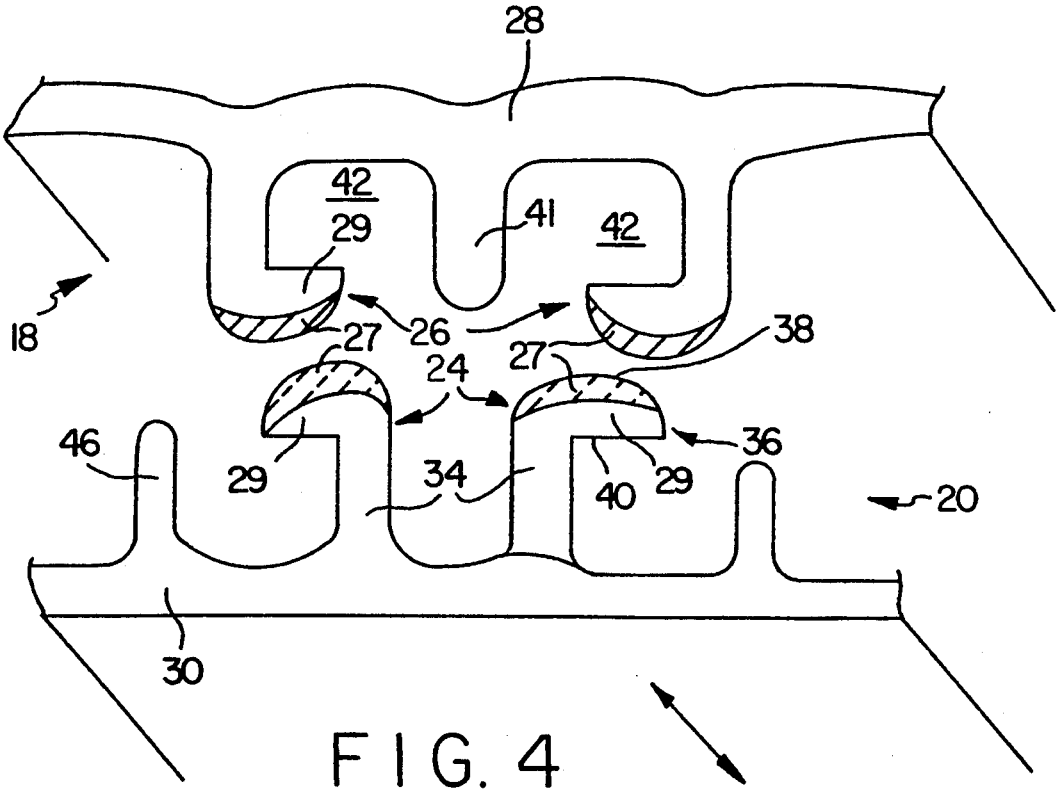
FIG. 4 is a view similar to FIG. 3 depicting a third embodiment of the invention.

In accordance with yet another embodiment of this invention depicted in FIG. 4, the outermost surfaces 38 of the first and second tips 36 may be formed of a first color 27 while the inner surfaces 40 are formed of second color 29. In this embodiment, successful mating engagement of the tip extremities will result in the first color 27 being visually observable through either continuous web 28,30 as a pair of continuous bands of said color, respectively. Incomplete mating will result in the first and second colors 27,29 being observable as adjacent band portions through either continuous web 28 or 30, as depicted in a manner similar to FIG. 2B. In the FIG. 4 embodiment, it is to be understood that the second or underlying color 29 may be formed as a backing color (e.g., white) to provide better contrast with the first color 27. The region 40 of the second color 29 may extend only for a small area beneath the tips 36, or may extend for a larger portion of the first and second members, or may even comprise the entire first and second members, except for the tips 36.

In any of the foregoing embodiments, it is to be understood that one or two colors may be formed on each extremity as a co-extrusion with the stems being simultaneously co-extruded from a clear resin. The colors may also be printed.

Figure 5:
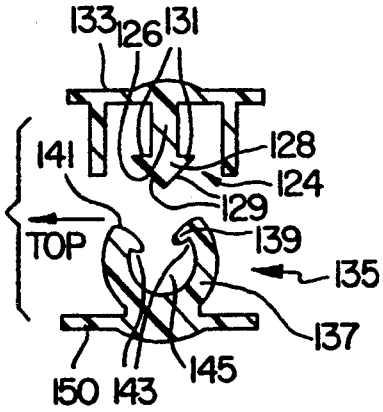
FIG. 5 is a view similar to FIG. 3 depicting a fourth embodiment of the invention.

Another commonly used closure element is depicted in FIG. 5 wherein a first or male element 124 is a single stem 126 (i.e., a rib extending continuously the length of the closure element) having an arrow-shaped distal end 128 of approximately triangular cross-section. In this embodiment, the outer surfaces 129 converging together in a point may be of a first color while the inner surfaces 131 facing the web 133 and connecting the outer surfaces to the stem 126 may be of a second color in a manner similar to the embodiment of FIG. 4. The second or female element 135 is formed with a pair of curved ribs 137 each having hooked distal ends 139 spaced from each other a distance less than the width of the first tip 128. The outermost convex surfaces 141 of the second rib members 137 are colored the first color and the innermost surface 143 of the second rib members extending toward each other to define the entrance to the locking cavity 145 are colored the second color. Upon successful and complete mating engagement of the first and second elements 124,135, the first colors will be visually observable through the translucent webs 133,150 as continuous bands of first color. Incomplete mating will result in adjacent bands of first and second color being simultaneously visually observable through the same translucent web 133 or 150 as discussed supra.

Figure 6:
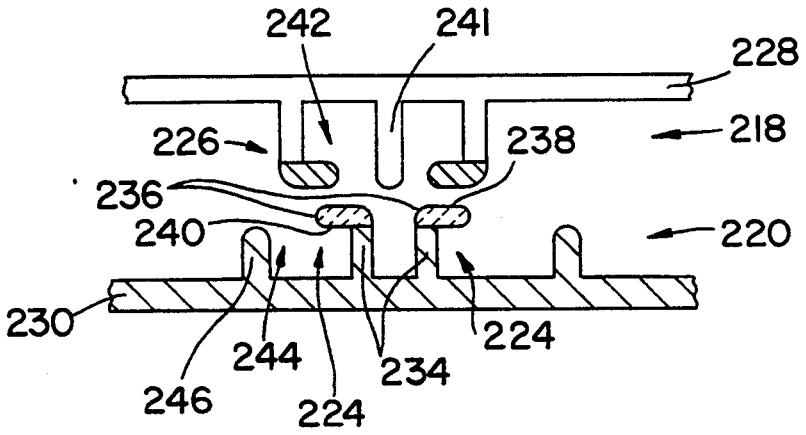
FIGS. 6 and 6A are sectional views depicting structural specifics of a presently preferred embodiment of this invention in open and mating engagement, respectively.

FIG. 6 is a sectional view of a preferred embodiment of the instant invention wherein the second closure element 220 includes a pair of hook-like projections 224 projecting from an opaque web 230 in spaced parallel relationship to each other. Each hook-like projection 224 is formed with a rib 234 of stem or stalk-like configuration extending generally perpendicular to the web 230 and having a hook-like distal end 236 or tip extending approximately perpendicular to its stem 234. The outermost surface 238 of each tip 236 which faces away from the associated web 230 is generally defined by a convex curve and an inner surface 240 of the tip which faces the web 230 is either straight or slightly concave although it may be convex as well.

Figure 6A:
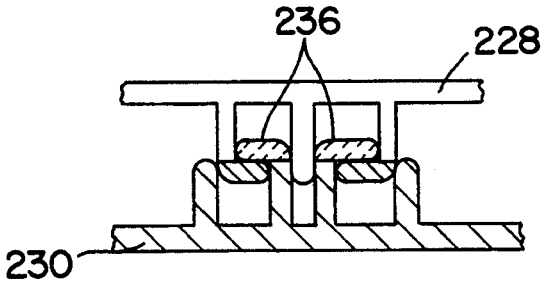

The first closure element 218 is also formed with a pair of hook-like projections 226 extending from its associated continuous web 228 which is preferably transparent or otherwise capable of enabling the color of tips 236 to be visually observable therethrough. These hook-like projections 226 are also formed with a stem-like rib 234 and a hook tip 236 that may be similar in construction to the hook-like projections 224 except that the stems 234 of the hook-like projections 226 of the first closure element 218 are spaced further apart from each other than the stems on the second closure elements 224 to define, in cooperation with a wall 241 extending parallel to and between the first members 226, a pair of locking channels or cavities 242. The hook-like projections 224 of the second closure element 220 are adapted to enter into the locking cavities 242 by virtue of resiliently yielding bias of the tips 236 of the first and second hook-like projections 224,226 as the continuous webs 228,230 are brought together under manual finger pressure during closure of the bag 10. As depicted in FIG. 6A, full mating engagement of the second and first closure elements 224,226 results in sealing contact between portions of the outermost surface 238 of the tips of the second members with wall 241 of the locking cavity 242 and corresponding sealing contact between the outermost surfaces of the tips of the second members 226 with the corresponding locking cavity 244 formed between the hook-like projections 224 and associated walls 246 formed outwardly and parallel to the hook-like projections.

As mentioned above, the interlocking extremities or tips 236 of the second and first closure elements 224 and 226 are guided into interlocking engagement within the respective locking cavities 242,244 in response to compressive force placed on the elements 218,220 as in the clamping together of the continuous webs 228,230 under manual finger pressure. In the preferred embodiment, the tips 236 of each of the two second elements 224 are colored a first color, such as blue, and the stalks 234 of each element 224 is colored a second color, preferably Opaque, such as white. The walls 246, stalks 234, and web 230 are all preferably colored the second or opaque color and the tips 236 of the first hook-like projections 226 of the first closure elements 218 as well as the wall 241 are also preferably colored a first color or an opaque color. The stalks of the first hook-like projections 226 and the associated web 228 are preferably transparent or translucent, i.e., colored in such a manner so that the first color of the second element tips 236 are visually observable as the first color and portions of the first tips forming intersections with the stalks of first elements 226 as well as the color of walls 246 are visually observable through the web 228 when the first and second closure elements are properly mated as depicted in FIG. 6A.

In the preferred embodiment, therefore, when the second and first elements 224 and 226 are fully mated together, the first or certain color on the second element tips 236 of second elements 224 are visually observable as continuous bands of that color through the opposing web 228 of the first element closure 218. This color (e.g., bright blue) and therefore the resulting continuous parallel bands are highly contrasted by the second color (preferably white) of the first element tips, wall 241 and walls 246 such that in the event incomplete mating occurs over various lengths of the first and second closure elements 218,220, such incomplete closure as in the manner of FIG. 2B would cause the continuous parallel bands of blue color to become wavy or non-parallel indicating areas of incomplete seals.

In the preferred embodiment, the second element tips 236 are co-extruded as the first color with the associated stems 234 which are co-extruded as the second or white color. Likewise, the walls 246 and associated web 230 are also co-extruded as the white color with the walls 234 and first color tips 236. The first element tips are co-extruded as the white or opaque color with transparent stems 234 and a transparent web 228 which are preferably formed from a clear resin.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A container comprising a pair of transparent or translucent side walls for defining a container interior and at least one open end; and a closure device including a first closure element and a second closure element; said closure elements being formed with first and second webs respectively extending along said side walls adjacent said open end, said first and second closure elements being matable so that, upon mating engagement of said first and second closure elements along their substantially entire respective lengths, said open end is substantially entirely closed, and wherein tip portions of said first closure element are colored a first color, wherein the remaining portions of said first closure element and said first web are colored a second color, said second color being an opaque color, and wherein said second web is transparent or translucent so that upon substantially entirely complete mating of said first and second closure elements, said first color is visually observable through said second web as a continuous band of said first color, said first web providing contrast with said first color when the first and second closure elements are viewed through said second web.

2. The container of claim 1, wherein tip portions of said second closure element are colored said second color to provide contrast with said tip portions of said first color.

3. The container of claim 1, wherein the portions of said second closure element connecting said tips to said second web are made of a transparent or clear resin co-extruded with said tip portions.

4. A closure device for use on a transparent or translucent container comprising a first closure element and a second closure element; said closure elements being formed with first and second webs respectively, said first and second closure elements being matable along their substantially entire respective lengths, and wherein tip portions of said first closure element are colored a first color, wherein the remaining portions of said first closure element and said first web are colored a second color, said second color being an opaque color, and wherein said second web is transparent or translucent so that upon substantially entirely complete mating of said first and second closure elements, said first color is visually observable through said second web as a continuous band of said first color, said first web providing contrast with said first color when said first and second closure elements are viewed through said second web.

5. The closure device of claim 4, wherein tip portions of said second closure element are colored said second color to provide contrast with said top portions of said first color.

6. The closure device of claim 5, wherein the portions of said second closure element connecting said tips to said second web are made of a transparent or clear resin co-extruded with said tip portions.

7. A method of determining whether a transparent or translucent container is closed, said container having at least one open end carrying a closure device which includes a first closure element and a second closure element which are matable with each other so that upon mating engagement along their substantially entire lengths, said open end is substantially entirely closed, tip portions of said first closure element being colored a first color and remaining portions of said first closure element and a first web carrying said first closure element being colored a second color, said second color being opaque, comprising the steps of:

a) interlocking said first closure element with said second closure element; and b) visually observing the mated elements through a second web carrying said second closure element, said second web being transparent or translucent, to determine whether said first color appears through said second web as a continuous band of said first color which signifies that full mating has occurred.

* * * * *